US008128014B2

(12) United States Patent
Allenius et al.

(10) Patent No.: US 8,128,014 B2
(45) Date of Patent: Mar. 6, 2012

(54) TURBO PULP LIFTER

(75) Inventors: Hans Allenius, Espoo (FI); Sami Hindström, Pusula (FI); Markku Virtanen, Espoo (FI); Kari Saloheimo, Espoo (FI)

(73) Assignee: Outotec Oyj, Espoo (FI)

( * ) Notice: Subject to any disclaimer, the term of this patent is extended or adjusted under 35 U.S.C. 154(b) by 262 days.

(21) Appl. No.: 12/582,950

(22) Filed: Oct. 21, 2009

(65) Prior Publication Data

US 2010/0314475 A1 Dec. 16, 2010

Related U.S. Application Data

(60) Provisional application No. 61/187,532, filed on Jun. 16, 2009.

(51) Int. Cl.
*B02C 19/00* (2006.01)

(52) U.S. Cl. ..... 241/291; 241/70

(58) Field of Classification Search ..... 241/183, 241/182, 284, 300, 70, 299, 291
See application file for complete search history.

(56) References Cited

U.S. PATENT DOCUMENTS

| | | | |
|---|---|---|---|
| 3,804,346 | A | 4/1974 | Norman |
| 4,323,199 | A | 4/1982 | Jardine et al. |
| 4,406,417 | A | 9/1983 | Jardine et al. |
| 7,566,017 | B2 | 7/2009 | Latchireddi |

FOREIGN PATENT DOCUMENTS

| | | |
|---|---|---|
| WO | 98/01226 | 1/1998 |

*Primary Examiner* — Mark Rosenbaum
(74) *Attorney, Agent, or Firm* — Chernoff, Villhauer, McClung & Stenzel

(57) ABSTRACT

A pulp lifter for installation in a rotary grinding mill has a leading edge wall and a trailing edge wall with respect to rotation of the mill. The leading edge wall and the trailing edge wall define a pulp lifter chamber, and a grate allows slurry to pass to a radially outward collecting region of the pulp lifter chamber for removal from the mill by way of a radially inward discharge region of the pulp lifter chamber. In one embodiment, a gate is positioned between the collecting region and the discharge region, the gate being movable between an open position, in which the gate permits solid material to pass from the collecting region to the discharge region, and a closed position, in which the gate prevents return movement of solid material from the discharge region to the collecting region.

8 Claims, 9 Drawing Sheets

TURBO PULP LIFTER

CROSS-REFERENCE TO RELATED APPLICATION

This application claims benefit of U.S. Provisional application Ser. No. 61/187,532 filed Jun. 16, 2009, the entire disclosure of which is hereby incorporated herein by reference for all purposes.

BACKGROUND OF THE INVENTION

This invention relates to a pulp lifter for installation in a grinding mill.

A conventional pulp lifter for a grate discharge mill comprises a plurality of chambers radially arranged to rotate against the downstream side of a vertical or sloped grate. Each pulp lifter chamber is defined between a trailing edge wall and a leading edge wall, relative to the direction of rotation of the mill. In the conventional pulp lifter, the trailing edge wall and leading edge wall are radial, and the trailing edge wall of a leading pulp lifter chamber is the leading edge wall of the next following pulp lifter chamber. The pulp lifter chambers are open towards the axis of the mill.

A mill charge of mineral or mixture of mineral and any grinding media on the upstream side of the grate tumbles as the mill rotates. Water is fed to the mill and as the mineral is comminuted by the tumbling action, the fine particles and the water form a slurry in the interstices of the mineral. Some of the slurry passes through the apertures in the grate. During a portion of each rotation of the mill, each pulp lifter chamber in turn passes against the mill charge on the upstream side of the grate and slurry passes through the grate to a collecting region of the pulp lifter chamber.

As the mill rotates, the material in the pulp lifter chamber is lifted upward. The orientation of the pulp lifter chamber changes until ultimately the chamber is open downwards and material may fall downward from the chamber onto a discharge cone, which directs the material towards a discharge opening of the mill.

Developments of the conventional pulp lifter are described in U.S. Pat. No. 7,566,017 issued Jul. 28, 2009 and International Publication No. WO 98/01226, the entire disclosure of each of which is hereby incorporated by reference herein for all purposes. The pulp lifter disclosed in U.S. Pat. No. 7,566,017 is partially modular, in that each pulp lifter chamber is formed by a separate pulp lifter module, and the separate modules are assembled in a support structure. Moreover, the grate is integrated into the pulp lifter modules.

The material that enters a pulp lifter chamber through the grate has two principal fractions, namely a slurry fraction, composed of water and particles that are smaller than about few millimeters, and a pebble fraction, composed principally of stones that are larger than about few centimeters. The discharge position of the slurry depends on the mill rotational speed and the effective mill diameter. When the mill is viewed as rotating in the counterclockwise direction, the slurry fraction in a pulp lifter chamber starts flowing toward the discharge cone when the pulp lifter chamber is at about the 2:00 o'clock position and is discharged almost completely by the time that the pulp lifter chamber attains the 10:30 to 11:00 o'clock position. The pebble fraction on the other hand moves much less easily and does not start to fall toward the discharge cone of the pulp lifter until the pulp lifter chamber reaches about the 1:00 o'clock position, depending on the mill speed. For a short interval of rotation about the 12:00 o'clock position, the pebbles fall freely but from about 11:00 o'clock to the 10:00 o'clock position they strike the leading edge wall of the pebble lifter chamber and slide down the leading edge wall. After 10:00 o'clock, the sliding movement of the pebble fraction slows down and in any event any pebbles that fall from the pulp lifter chamber might not be discharged by the discharge cone but fall into another chamber of the pulp lifter. Thus, a large proportion of the pebble fraction is not discharged but remains in the pulp lifter over several rotations. This operation of the conventional pulp lifter is illustrated in FIG. 1.

The recycling pebbles form a dead load behind the grate, which reduces the volumetric capacity of the pulp lifters by partially occupying the effective volume of the pulp lifters and increases the mass of the mill. In addition, the recycling pebbles may block the grate openings, and the presence of a quantity of pebbles in the pulp lifter reduces the flow gradient through the grate, and may cause a slurry pool to be formed in the mill. It is therefore desirable to reduce the proportion of the pebble fraction that remains in the pebble lifter over multiple rotations of the mill.

The object of the present invention is to eliminate drawbacks of the prior art and to achieve a more effective apparatus for discharging material from a mill, which is used for grinding or comminution, even at the higher rotating speeds of the mill.

SUMMARY OF THE INVENTION

In accordance with a first aspect of the disclosed subject matter there is provided a pulp lifter for installation in a rotary grinding mill, the pulp lifter comprising a leading edge wall and a trailing edge wall with respect to rotation of the mill, wherein the leading edge wall and the trailing edge wall define a pulp lifter chamber, the pulp lifter including a grate that allows slurry to pass to a radially outward collecting region of the pulp lifter chamber for removal from the mill by way of a radially inward discharge region of the pulp lifter chamber, and the pulp lifter further comprises a gate positioned between the collecting region and the discharge region, the gate being movable between an open position, in which the gate permits solid material to pass from the collecting region to the discharge region, and a closed position, in which the gate prevents return movement of solid material from the discharge region to the collecting region.

In accordance with a second aspect of the disclosed subject matter there is provided a pulp lifter for installation in a rotary grinding mill, the pulp lifter comprising a leading edge wall and a trailing edge wall with respect to rotation of the mill, wherein the leading edge wall and the trailing edge wall define a pulp lifter chamber, the pulp lifter including a grate that allows slurry to pass to the pulp lifter chamber for removal from the mill by way of a radially inward discharge region of the pulp lifter chamber, and wherein the trailing edge wall has a radially outer end and a radially inner end and is inclined relative to a radius of the pulp lifter such that the radially inner end of the trailing edge wall lags rotationally relative to the radially outer end of the trailing edge wall.

In accordance with a third aspect of the disclosed subject matter there is provided a pulp lifter for installation in a rotary grinding mill, the pulp lifter comprising a leading edge wall and a trailing edge wall with respect to rotation of the mill, wherein the leading edge wall and the trailing edge wall define a pulp lifter chamber, the pulp lifter including a grate that allows slurry to pass to a radially outward collecting region of the pulp lifter chamber for removal from the mill by way of a radially inward discharge region of the pulp lifter chamber, and wherein the trailing edge wall has an S-shaped curvature between a radially outer end and a radially inner end whereby the radial position of maximum slope of the trailing edge wall varies during rotation of the pulp lifter.

In accordance with a fourth aspect of the disclosed subject matter there is provided a pulp lifter for installation in a grinding mill, the pulp lifter comprising a leading edge wall and a trailing edge wall with respect to rotation of the mill, wherein the leading edge wall and the trailing edge wall define a pulp lifter chamber, the pulp lifter including a grate that allows slurry to pass to a radially outward collecting region of the pulp lifter chamber for removal from the mill by way of a radially inward discharge region, and wherein the leading edge wall is provided with a projection between a radially outer end and a radially inner end of the leading edge wall, the projection being configured to form a pocket for receiving pebbles that land on the leading edge wall during rotation of the pulp lifter, to prevent the pebbles that enter the pocket from passing to the collecting region of the pulp lifter chamber.

In accordance with a fifth aspect of the disclosed subject matter there is provided a pulp lifter for installation in a rotary grinding mill, the pulp lifter comprising a leading edge wall and a trailing edge wall with respect to rotation of the mill, wherein the leading edge wall and the trailing edge wall define a pulp lifter chamber, the pulp lifter including a grate that is formed with openings that allow slurry to pass to a radially outward collecting region of the pulp lifter for removal from the mill by way of a radially inward discharge region, and wherein the openings in the grate are distributed such that an area of the grate nearer the trailing edge wall has substantially fewer openings than an area of the grate nearer the leading edge wall, whereby the grate and the trailing edge wall form a pocket for retaining slurry as the mill rotates and the pulp lifter chamber rises from a lower position towards a higher position.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figures 1A, 1B, 1C:
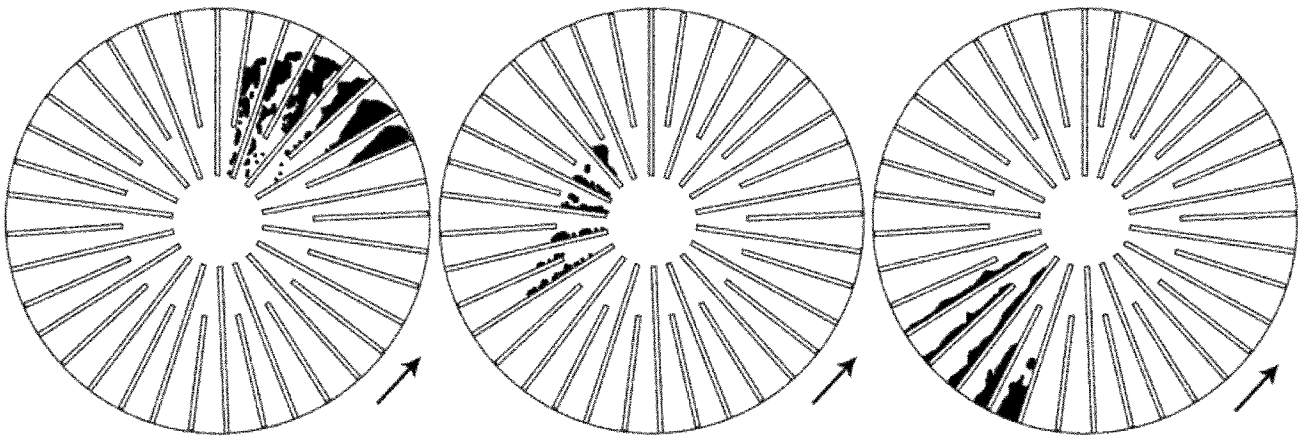
FIGS. 1A, 1B, and 1C (collectively referred to as FIG. 1) illustrate carryover of pebbles in a conventional pulp lifter.
Figure 2A:
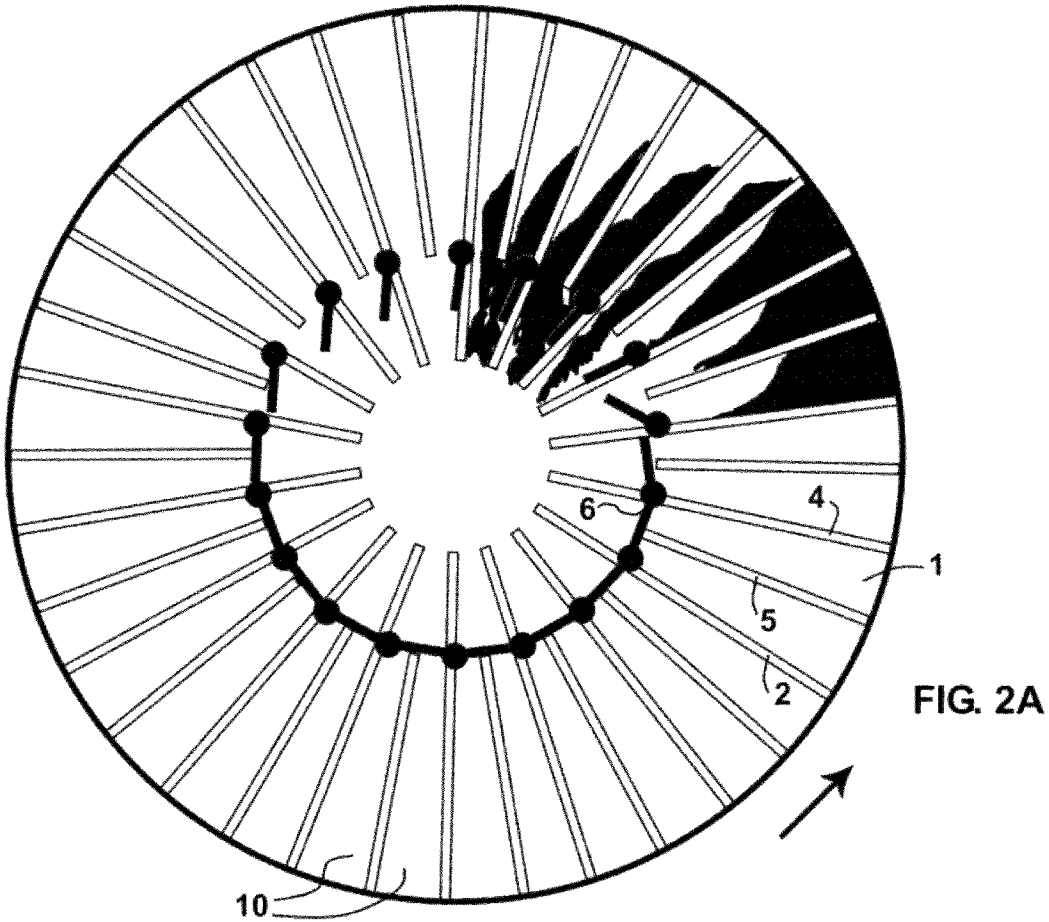
FIGS. 2A-2D illustrate operation of a first pulp lifter embodying subject matter disclosed in this application.

Referring to FIG. 2A, a pulp lifter chamber 1 is defined between a trailing edge wall 2 and a leading edge wall 4 (relative to the counterclockwise direction of rotation of the mill). Each pulp lifter chamber 1 is provided with a pebble gate 6 that is mounted for pivotal movement about an axis adjacent the trailing edge wall of the pulp lifter chamber. The gate 6 is able to turn through an angle of about 90° between an open position, in which it rests against the trailing edge wall 2 and extends substantially radially inward from its pivot axis, and a closed position, in which it extends substantially circumferentially towards the leading edge wall 4 of the pulp lifter chamber. When the gate 6 is closed, it divides the pulp lifter chamber radially between an outer collecting region and an inner discharge region. The outer region of the chamber is divided by an intermediate wall 5 into a trailing compartment and a leading compartment. Alternatively the pebble gate may be hinged between the leading edge wall and the intermediate wall or between the intermediate wall and the trailing edge wall between the collecting region and the discharge region. Pivotal movement of the gate between its open and closed positions takes place automatically due to the force of gravity on the gate and the load on the gate. Movement of the gate may be assisted and/or damped by an actuator operated by external force, e.g. pneumatically or electro-mechanically. As shown in FIGS. 2A-2D, the gate starts to open when the pulp lifter chamber is at about the 3:00 o'clock position and is fully open from about 2:00 o'clock to 11:30. The gate closes during rotation from about 11:30 to 9:00 o'clock and remains fully closed until about 3:00o'clock.

Figure 2B:
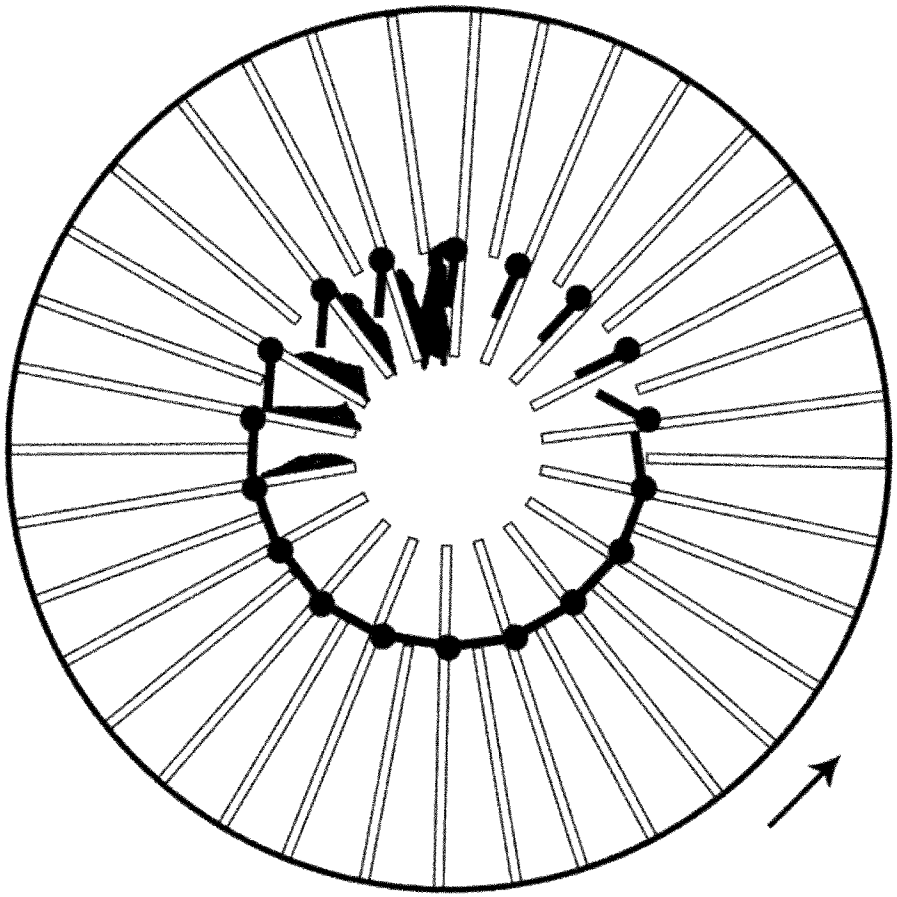
Figure 2C:
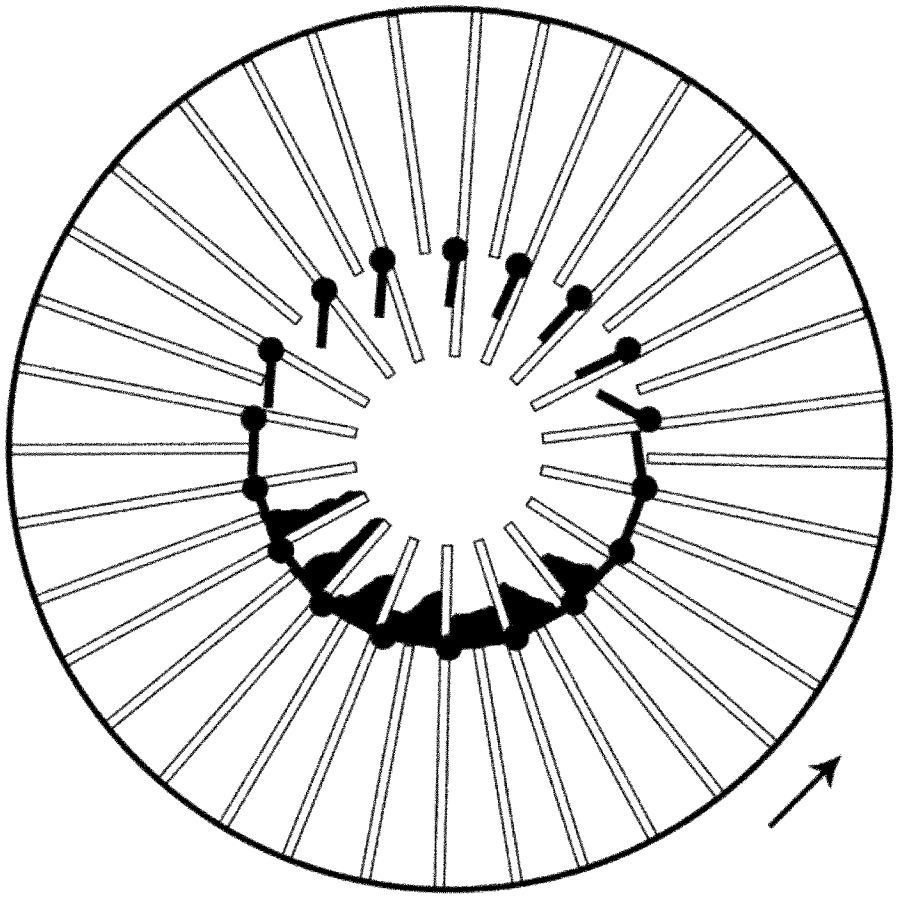
Figure 2D:
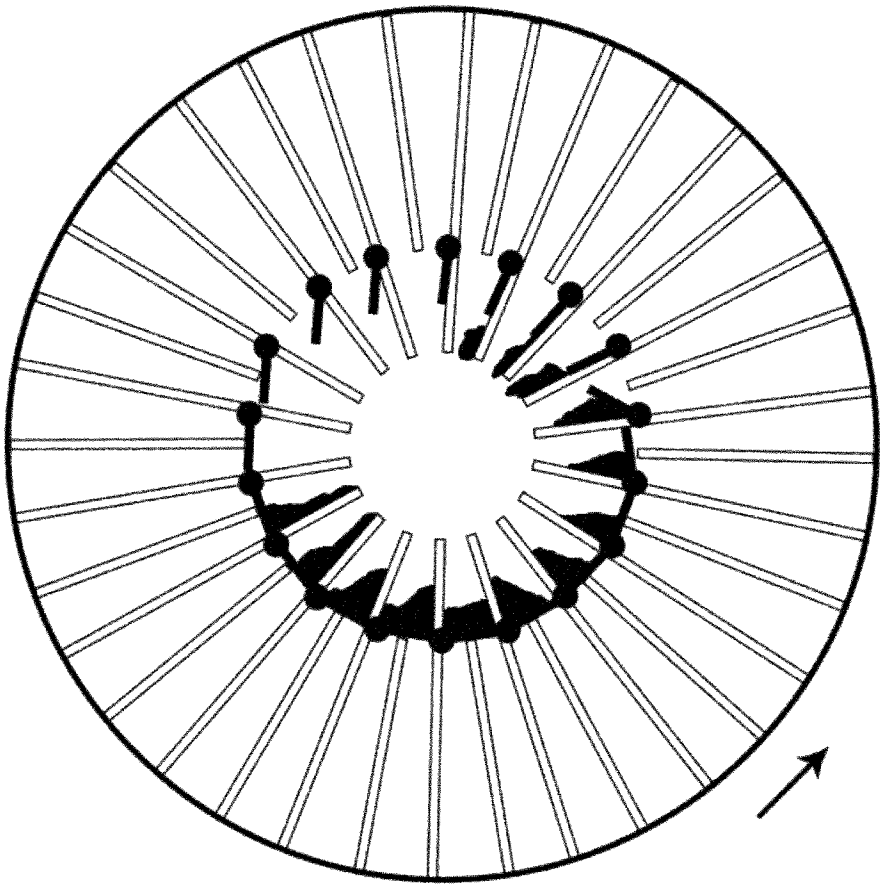

When a pulp lifter chamber is at the 6:00 o'clock position, slurry and pebbles pass through the grate into the collecting region 10 of the pulp lifter chamber. The pulp lifter rotates and when the chamber reaches about the 2:00 o'clock position, the pebbles start to slide down the intermediate wall and the trailing edge wall of the pulp lifter chamber. As the pulp lifter continues to rotate, some of the pebbles are discharged from the pulp lifter chamber and some pass the gate 6 but are not discharged. A small proportion of the pebble fraction may remain radially outward of the gate in the collecting region of the chamber, as shown in FIG. 2B. At about the 9:00 o'clock position, the gate is fully closed and the pebbles that passed the gate but were not discharged are blocked from returning to the collecting region by the closed gate, as shown in FIG. 2C. Thus, as the pulp lifter continues to rotate (and the chamber picks up another charge of slurry and pebbles in the collecting region) the pebbles in the radially inner discharge region of the pulp lifter chamber are blocked from returning to the collecting region. When the pulp lifter chamber reaches the 2:00 o'clock position, and the gate is fully open, the pebbles that are in the discharge region of the pulp lifter chamber slide down the trailing edge wall towards the discharge cone. Because these pebbles are located in the radially inner discharge region, the distance that they must travel in order to be discharged from the chamber onto the discharge cone is short and a large proportion of the pebbles will be discharged.

It will be understood that gravity supplies a centripetal force that brings about radially inward movement of the pebbles, and that for a given rotational speed of the pulp lifter, the centripetal force that is required to move the pebbles inward is directly proportional to the radius of the path followed by the pebbles. Because of the smaller radius of the path of travel of the pebbles in the discharge region, the force required to bring about inward movement is smaller for a pebble in the inner discharge region than for a pebble of the same mass in the collecting region and accordingly inward movement of the pebbles in the discharge region starts earlier in the rotation cycle.

In the case of the pulp lifter shown in FIG. 2, the grate (not shown in FIG. 2) may be separate from the pulp lifter or, in the event that the pulp lifter is modular, may be integrated into the pulp lifter. When the pulp lifter shown in FIG. 2 is in use, slurry and pebbles pass through the holes in the grate and enter the collecting region of a pulp lifter chamber when the collecting region is at least partly immersed in the material on the upstream side of the grate. The material in the collecting region of the pulp lifter chamber collects against the trailing edge wall as the mill rotates, and the pulp lifter chamber rises.

As soon as the pulp lifter chamber is no longer immersed in the material on the upstream side of the grate, there is a tendency for the slurry and pebbles in the collecting region to pass back through the grate to the upstream side of the grate, thereby reducing the efficiency of the pulp lifter.

Figure 3:
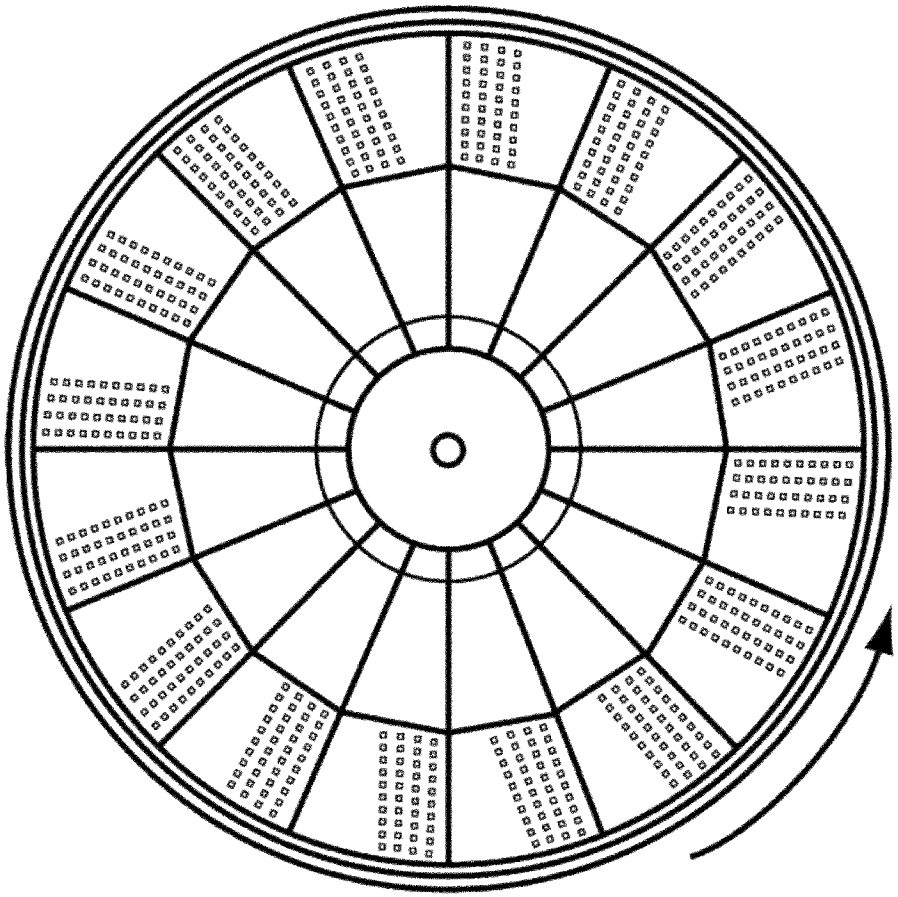
FIG. 3 illustrates schematically a second pulp lifter embodying subject matter disclosed in this application.

FIG. 3 shows the holes in the grate through which slurry and pebbles pass from the upstream side of the grate to the pulp lifter chamber when the collecting region is immersed in the material on the upstream side of the grate. It will be seen from FIG. 3 that a substantial proportion of the area of the grate is not formed with holes. This imperforate region of the grate is closer to the trailing edge wall of the pulp chamber than to the leading edge wall. The location of the imperforate region of the grate is chosen so that when the pulp lifter chamber rises, and slurry and pebbles collect in the outer trailing region of the chamber, they are prevented from passing back through the gate to the upstream side of the grate.

Figure 4:
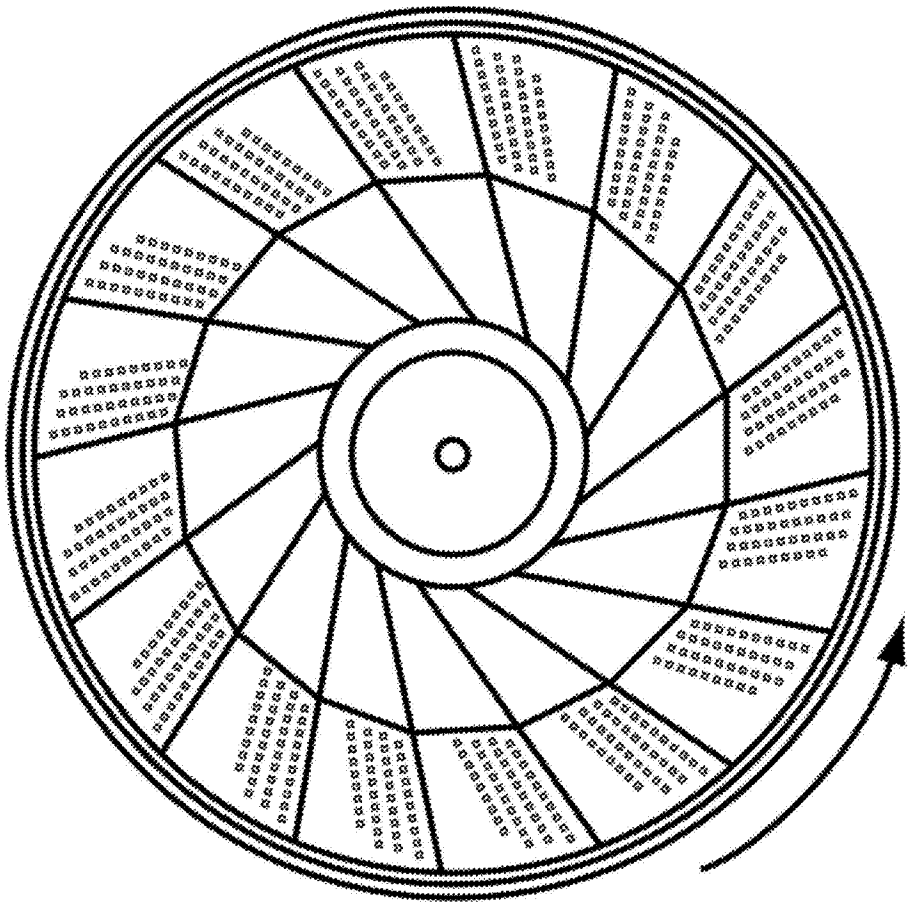
FIG. 4 illustrates schematically a third pulp lifter embodying subject matter disclosed in this application.

In the embodiments shown in FIGS. 2 and 3, the trailing edge walls of the adjacent pulp lifter chambers are radial, with the result that there is no significant radially inward movement of the pebbles in a pulp lifter chamber before the trailing edge wall of the pulp lifter chamber reaches about the 1:30 position, and is inclined at 45° to horizontal (although, as shown in FIG. 2A, the mass of slurry may slump before that point is reached). U.S. Pat. No. 7,566,017 discloses use of a modular pulp lifter with a curved guide to cause radially inward movement of the material before the pulp lifter reaches the 3:00 o'clock position, but such a pulp lifter is more expensive to produce than a pulp lifter in which the pulp lifter chamber is defined only between straight leading and trailing edge walls. In the case of the embodiment shown in FIG. 4, the walls that separate the pulp lifter chambers are straight but are not radial. Each trailing edge wall is inclined to the radius such that the inner end of the wall is rotationally behind the outer end. As shown in FIG. 4, this results in the trailing edge wall of each pulp lifter chamber attaining an inclination of about 45° to horizontal before the inner end of the trailing edge wall reaches the 3:00 o'clock position, with the result that the material in the pulp lifter chamber begins moving radially inwards toward the discharge cone earlier during the rotation of the pulp lifter than in the case of the conventional pulp lifter with radial walls.

Figure 5:
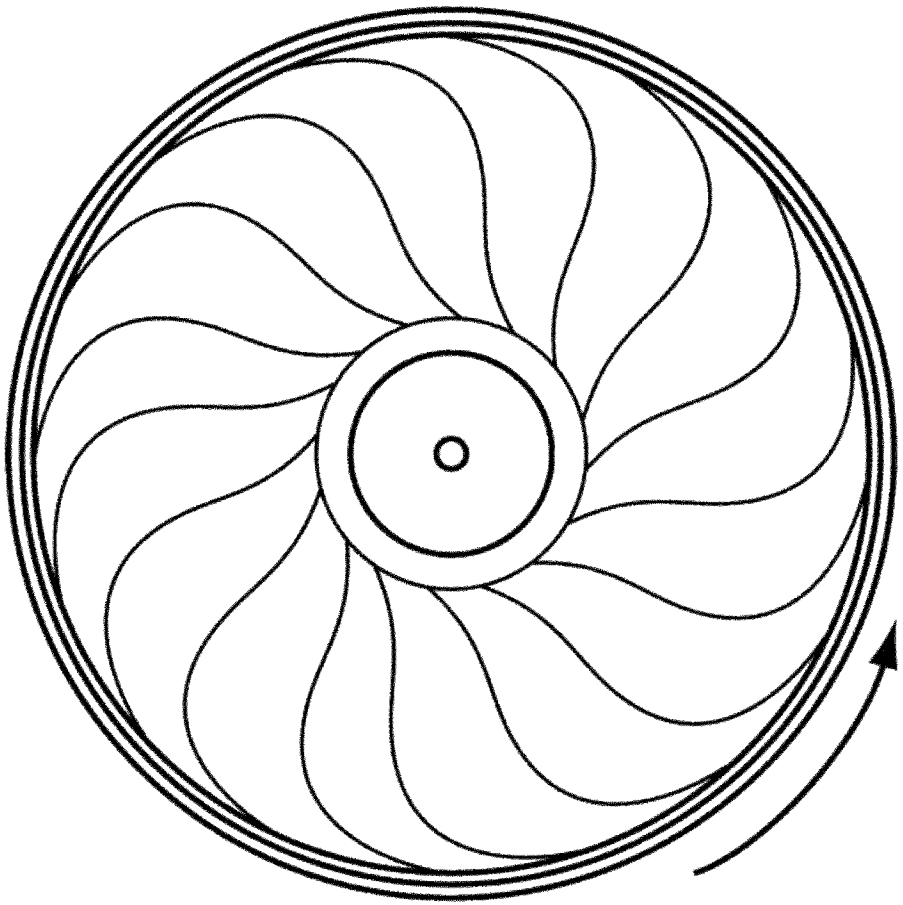
FIG. 5 illustrates schematically a fourth pulp lifter embodying subject matter disclosed in this application.

FIG. 5 illustrates another configuration of the walls that separate the pulp lifter chambers. As shown in FIG. 5, each wall (which is the leading edge wall of one pulp lifter chamber and the trailing edge wall of another pulp lifter chamber) has an S-shaped curvature such that the radial position at which the tangent to the wall is vertical depends on the angular position of the wall. As shown in FIG. 5, the curvature is such that the outer segment of the wall is already inclined at a relatively steep angle when the radially inner end of the wall is at about the 5:00 o'clock position, so that the slurry and pebbles start moving radially inward well before the wall reaches the 1:00 o'clock position. By moving the material inward, the centripetal force that must be supplied by gravity in order to bring about radial inward movement of the pebbles is reduced. As the pebbles move inward, the slope of the trailing edge wall is reduced, but since the centripetal force is reduced, the pebbles continue to move inward. When the inner end of the wall is between about 2:30 and 1:00 o'clock, the inner segment of the wall is steep and the pebbles move readily toward the discharge cone and are diverted to the outlet of the mill.

Figure 6:
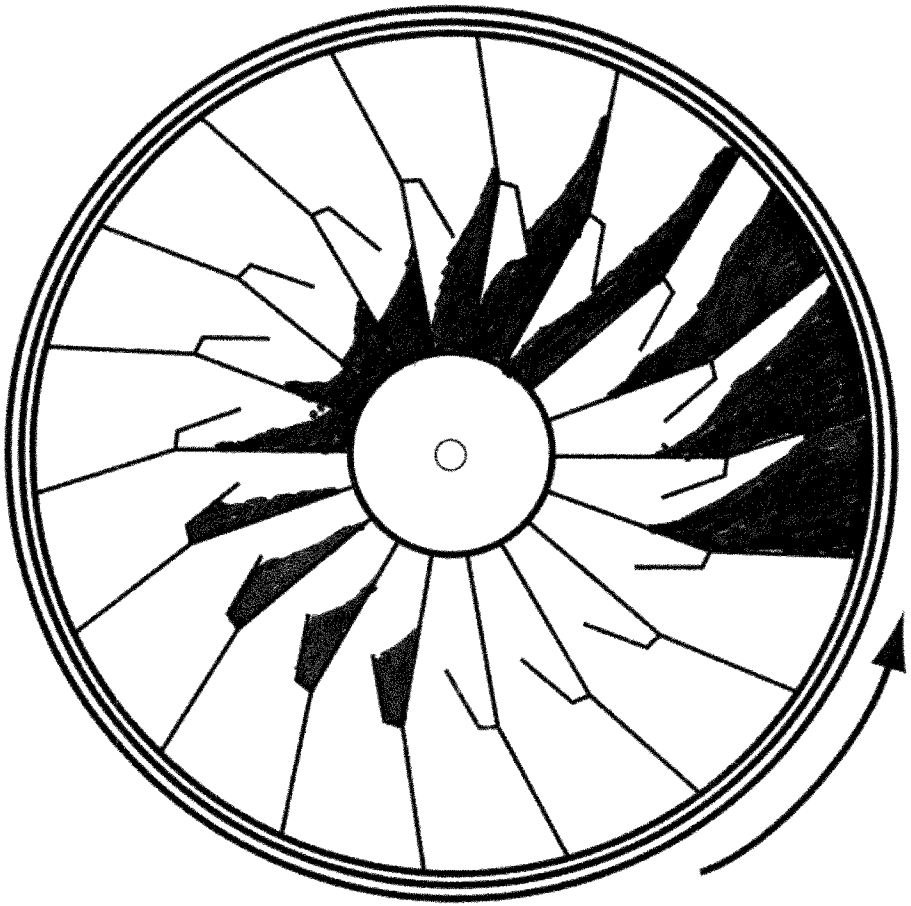
FIG. 6 illustrates schematically a fifth pulp lifter embodying subject matter disclosed in this application.

FIG. 6 illustrates a further modification in which each wall separating two adjacent pulp lifter chambers is provided on one side with a projection that performs a similar function to the gate described with reference to FIG. 2. The projection forms a pocket on the leading edge wall of the pulp chamber. The outer part of the wall is inclined to the radius, as described with reference to FIG. 4, in order to initiate inward movement of the slurry and pebbles early in the rotation cycle, and the inner part of each wall is radial. Thus, as the pulp lifter chamber rises, the slurry and pebbles move radially inward, but some material remains in the chamber, resting on the leading edge wall of the chamber, when the inner segment of the wall reaches the 9:00 o'clock position. On further rotation of the pulp lifter, the material will move outward, away from the cone. As the material moves down the leading edge wall, it encounters the projection, which is configured as a pocket. The material enters the pocket and is retained by the pocket and prevented from returning to the collecting region of the chamber. The material in the pocket will start to fall from the pocket when the inner segment of the wall reaches about the 3:00 o'clock position, but at this point the slumping of the material in the collecting region prevents the material from the pocket from passing outward, away from the cone.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A pulp lifter for installation in a rotary grinding mill, the pulp lifter comprising a leading edge wall and a trailing edge wall with respect to rotation of the mill, wherein the leading edge wall and the trailing edge wall define a pulp lifter chamber, the pulp lifter including a grate that allows slurry to pass to a radially outward collecting region of the pulp lifter chamber for removal from the mill by way of a radially inward discharge region of the pulp lifter chamber, and the pulp lifter further comprises a gate positioned between the collecting region and the discharge region, the gate being movable between an open position, in which the gate permits solid material to pass from the collecting region to the discharge region, and a closed position, in which the gate prevents return movement of solid material from the discharge region to the collecting region.

2. A pulp lifter according to claim 1, wherein the gate is attached to the trailing edge wall of the pulp lifter, in a manner allowing pivotal movement of the gate relative to the trailing edge wall between a closed position, in which the gate extends substantially circumferentially, and an open position, in which the gate extends substantially radially.

3. A pulp lifter according to claim 2, wherein the pulp lifter comprises an intermediate wall that divides the collecting region into an upstream compartment and a downstream compartment.

4. A pulp lifter for installation in a rotary grinding mill, the pulp lifter comprising a leading edge wall and a trailing edge wall with respect to rotation of the mill, wherein the leading edge wall and the trailing edge wall define a pulp lifter chamber, the pulp lifter including a grate that allows slurry to pass to the pulp lifter chamber for removal from the mill by way of a radially inward discharge region of the pulp lifter chamber, and wherein the trailing edge wall has a radially outer end and a radially inner end and is inclined relative to a radius of the pulp lifter such that the radially inner end of the trailing edge wall lags rotationally relative to the radially outer end of the trailing edge wall.

5. A pulp lifter for installation in a rotary grinding mill, the pulp lifter comprising a leading edge wall and a trailing edge wall with respect to rotation of the mill, wherein the leading edge wall and the trailing edge wall define a pulp lifter chamber, the pulp lifter including a grate that allows slurry to pass to a radially outward collecting region of the pulp lifter chamber for removal from the mill by way of a radially inward discharge region of the pulp lifter chamber, and wherein the trailing edge wall has an S-shaped curvature between a radially outer end and a radially inner end whereby the radial position of maximum slope of the trailing edge wall varies during rotation of the pulp lifter.

6. A pulp lifter for installation in a grinding mill, the pulp lifter comprising a leading edge wall and a trailing edge wall with respect to rotation of the mill, wherein the leading edge wall and the trailing edge wall define a pulp lifter chamber, the pulp lifter including a grate that allows slurry to pass to a radially outward collecting region of the pulp lifter chamber for removal from the mill by way of a radially inward discharge region, and wherein the leading edge wall is provided with a projection between a radially outer end and a radially inner end of the leading edge wall, the projection being configured to form a pocket for receiving pebbles that land on the leading edge wall during rotation of the pulp lifter, to prevent the pebbles that enter the pocket from passing to the collecting region of the pulp lifter chamber.

7. A pulp lifter for installation in a rotary grinding mill, the pulp lifter comprising a leading edge wall and a trailing edge wall with respect to rotation of the mill, wherein the leading edge wall and the trailing edge wall define a pulp lifter chamber, the pulp lifter including a grate that is formed with openings that allow slurry to pass to a radially outward collecting region of the pulp lifter for removal from the mill by way of a radially inward discharge region, and wherein the openings in the grate are distributed such that an area of the grate nearer the trailing edge wall has substantially fewer openings than an area of the grate nearer the leading edge wall, whereby the grate and the trailing edge wall form a pocket for retaining slurry as the mill rotates and the pulp lifter chamber rises from a lower position towards a higher position, and wherein the trailing edge wall has a radially outer end and a radially inner end and is inclined relative to a radius of the pulp lifter such that the radially inner end of the trailing edge wall lags rotationally relative to the radially outer end of the trailing edge wall.

8. A pulp lifter according to claim 7, wherein the leading edge wall and the trailing edge wall extend substantially radially of an axis of rotation of the pulp lifter.

* * * * *